United States Patent [19]

Borse

[11] Patent Number: 4,860,469

[45] Date of Patent: Aug. 29, 1989

[54] APPARATUS FOR EXHIBITING GRAINS OF PRECIOUS STONE

[75] Inventor: Dietrich Borse, Hamburg, Fed. Rep. of Germany

[73] Assignee: Firma Ernst Winter & Sohn (GmbH & Co.), Hamburg, Fed. Rep. of Germany

[21] Appl. No.: 151,574

[22] Filed: Feb. 2, 1988

[30] Foreign Application Priority Data

Feb. 10, 1987 [DE] Fed. Rep. of Germany ..... 3703979

[51] Int. Cl.[4] ..... G09F 19/00

[52] U.S. Cl. ..... 40/409; 40/470

[58] Field of Search ..... 40/409, 406, 410, 326

[56] References Cited

U.S. PATENT DOCUMENTS

| | | | |
|---|---|---|---|
| 1,627,270 | 5/1927 | Burnham | 40/409 |
| 3,692,382 | 9/1972 | Cloutier | 40/409 |
| 4,332,096 | 6/1982 | Kohner et al. | 40/409 |
| 4,521,982 | 6/1985 | Altuchow | 40/407 |
| 4,579,399 | 4/1986 | Poltash | 312/107 |

FOREIGN PATENT DOCUMENTS

| | | | |
|---|---|---|---|
| 65042 | 7/1942 | Norway | 40/409 |

*Primary Examiner*—Gene Mancene
*Assistant Examiner*—Wenceslao J. Contreras
*Attorney, Agent, or Firm*—Toren, McGeady & Associates

[57] ABSTRACT

Apparatus for exhibiting grains of precious stone comprises in a container assembly at least two communicating compartments, which communicate with each other through at least two passageway, which constitutes a singling path for grains of precious stone. That communicating passageway is constricted so as to permit singled grains having a given size to move freely through the passageway. The container assembly contains an aggregation of grains of precious stone. The at least two compartments communicating with each other have different elevations. The communicating passageway is defined by a slideway, which is inclined from the vertical, or constitutes a path for a free fall of grains of precious stone from the aggregation. Such apparatus can be used as a sales display container, an ornament, or a gift article.

8 Claims, 5 Drawing Sheets

APPARATUS FOR EXHIBITING GRAINS OF PRECIOUS STONE

BACKGROUND OF THE INVENTION

1. Field of the Invention

This invention relates to apparatus for exhibiting grains of precious stone.

2. Description of the Prior Art

Small particles consisting of grains of precious stone are used for various purposes. They may be used as parts of tools, such as grinding wheels, grinding belts or arcuate abrasive members. Diamond grains are mainly used for said purposes.

Grains of precious stone may also be used as ornament or for advertising purposes.

Grains having specified properties are required for certain purposes. In the previous practice, grains have been kept in boxes or in so-called diamond papers in order to exhibit material which is suitable for a certain purpose. In that case the grains of precious stone constitute an aggregation so that their shape and their optical activity under special conditions, e.g., conditions of illumination, are not readily apparent.

SUMMARY OF THE INVENTION

It is an object of the invention to provide an exhibiting apparatus which permits a mass or aggregation of grains of precious stone to be inspected in an improved manner for the characteristics of the individual grains in such a manner that specific properties will become apparent in a desirable manner.

That object is accomplished by the provision of the apparatus defined in claim 1.

The term compartment is used to describe a compartment which is defined by and closed to the outside by walls of a container. The apparatus comprises housing or container means having an outer wall or a container assembly consisting of a plurality of containers.

Because the grains of precious stone of which the aggregation is composed are singled in the apparatus, the properties of each particle of the aggregation can be inspected more easily than when the aggregation is containerd in a box. As the grains of precious stone perform a singling movement, special effects of said grains can be made apparent.

For a comparison, reference is made, e.g., to so-called hourglasses, in which particles are used which have rounded surfaces which are not capable or are only slightly capable of a reflection or refraction of light. Such articles have only a field of application and the characteristics of the material exhibited by such articles are of minor significance.

The invention provides an article for an inspection of grains of precious stone and also an article which in special embodiments cn be used to produce surprising effects so that the article may be used as ornament or for advertising.

The statement that at least two compartments are provided, which communicate with each other, covers also an arrangement comprising three or mroe compartments, which are arranged one below the other. Special effects may be produced if the features of claims 27 and 28 are adopted.

The statement of a relationship to the grain size means that the communicating passageway must be larger in diameter than a grain. The diameter of the communicating passageway is suitably at least four times the grain diameter so that the singled grains virtually constitute a single file as they fall through the communicating passageway.

Particularly desirable features of the exhibiting apparatus are defined in claims 2 to 17. If the container means have the three-dimensional design set forth in claims 2 to 4, the exhibiting apparatus will be structurally simple but effective, particularly if a technical inspection of the material being handled is desired. Owing to the provision of the slideway, the movement through the communicating passageway will be retarded so that the inspection will be intensified or the effect will be prolonged. Attention to the features of claims 11 to 13, 14 and 27 and 28 is directed in that context.

In the preferred embodiment the grains of precious stone traverse the singling pass in a free fall. In that case a light source may be used in such a manner that effects produced by the reflection and/or refraction of light will be particularly impressive owing to the unrestrained movement.

The grains of precious stone which are provided desirably embody the features of claims 4 and 5 so that special effects can be produced in view of what has been said herein before. The size of the grains is also significant in that context.

It has surprisingly been found that this will provide not only a technically useful singling apparatus for an inspection but also a decorative article for various purposes, including an ornament.

From that aspect, attention is particularly directed to claims 7, 11 and 16. It will be understood that grains of colored precious stones can either be accommodated in separate container assemblies and/or may be mixed. Where grains in different colors are desired, colorless grains may be employed or combinations of blue, brown and yellow grains or of yellow, green and ivory-colored grains.

In a desirable embodiment defined in claim 8, the movement may be retarded also during a free fall and particularly the constricted communicating passageway may be ralatively wide so that the movement in the liquid will be retarded. A special result which will be obtained in that case is the intensification of the visual effect produced by the individual grains of precious stone particularly when they are illuminated.

In that context the difference between the indices of refraction should be as large as possible.

An observation from only one side will be preferred and is suitably provided by the embodiment defined in claim 7.

For a technical inspection, a sales display container in accordance with claim 6 or 14 may be provided and may have a light source associated with it.

The above features may be embodied in an ornament comprising grains of precious stone having a size in the stated range. In that case, motive forces can be exerted for a prolonged time by features recited in claims 10 and 16 so that an interesting ornament is provided. That ornament may be used as an advertising article because eye-catching effects will be produced owing to the brillance of the material that is employed.

In the suitable embodiments defined in claims 9 and 16, the precious stone material which is employed will produce special effects, particularly if it has different colors. In that connection the embodiments defined in claims 7 and 10 will also be desirable.

Claim 10 to 12 and 15 to 17 define embodiments which are particularly impressive for advertising purposes.

In accordance with claim 1 a singling path is provided and may be constituted by a constricted communicating passageway between compartments. Claim 13 defines a suitable embodiment in which the desired visual effects can be produced in a controlled manner at specific times.

Claims 11 and 16 define an embodiment with which pictorial effects can be produced with a brillance that has not been achieved before. Said embodiment also constitutes ornament or advertising articles with which the surprising effects are produced particularly with the aid of a source of light.

BRIEF DESCRIPTION OF THE DRAWING

FIG. 4 corresponding to a central sectional view in comparison with FIG. 3 but with different, shallower compartments.

DETAILED DESCRIPTION OF THE PREFERRED EMBODIMENT

Figure 1:
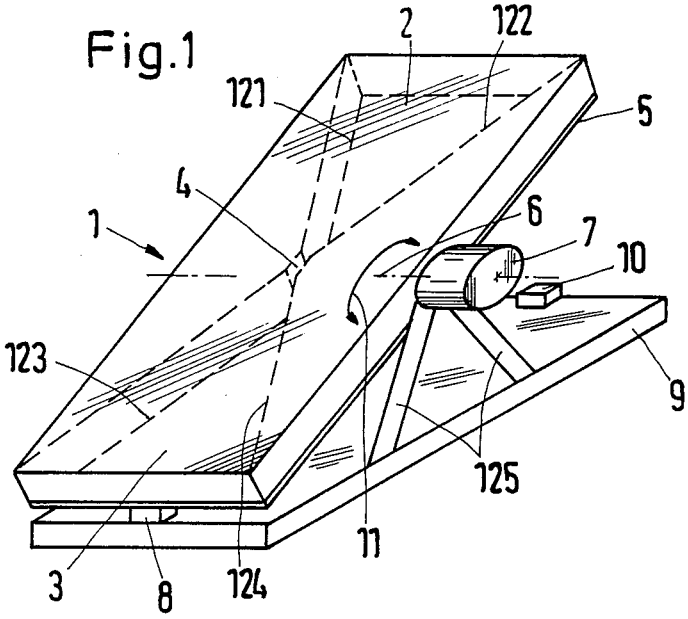
FIG. 1 shows an embodiment of a pivoted exhibiting apparatus.

The invention will now be described with reference to desirable illustrative embodiments which are shown in the drawing.

The invention will now be described with reference to desirable illustrative embodiments which are shown in the drawing.

FIG. 1 shows a tiltable container assembly comprising, e.g., two compartments 2, 3, which communicate with each other through a constricted passageway 4. In all embodiments of the invention, compartments such as 2, 3 are defined by a container assembly, such as 1. In the embodiment shown in FIG. 1 the compartments 2, 3 are defined by a rigid bottom plate 5 of the container assembly 1 and by side portions of that assembly, which are mounted on the bottom plate 5. The bottom plate 5 is mounted on a shaft 6 for a pivotal movement in the directions indicated by the double-headed arrow 11. That movement is effected by means of a drive unit which is secured to the rigid bottom plate 5 and suitably comprises an electric motor 7. The energization of the motor 5 is controlled in dependence on the instantaneous position of the apparatus, in which one end of the rigid bottom wall 5 may actuate a contact switch 8 or 10 at one end or the other of a base structure 9, on which the shaft 6 is carried by a suitable stand. Each of the compartments 2, 3 tapers to the communicating passageway 4. The rigid bottom plate 5 may be permeable to light so that special visual effects will be produced as the grains of precious stones move through the communicating passageway 4. It will be understood that the bottom plate 5 may consist at least in part of transparent material so that special radiant effects will be produced by means of a light source that is disposed behind the bottom plate 5.

The two compartments 2 and 3 are defined by inclinded side walls 121 to 124, which converge to form a constriction.

In this embodiment the electric motor 7 is connected to the shaft 6, which is non-rotatably connected to the container assembly 1 and is rotatably mounted in laterally disposed supports 125 mounted on the base 9. The side walls 121 to 124 extend at right angles to the rigid bottom plate 5. A transparent front wall may be provided which covers the compartment 2, 3 at the top.

The container assembly may be more steeply inclinded in its end positions than is shown on the drawing. For that purpose the stand in which the shaft 6 is mounted may be higher than shown. In that case, special stops may be provided for limiting the angular movement and for defining the inclination of the container assembly.

The contact switches 8 and 10 shown in FIG. 1 are provided to permit a repeated transfer of the grains of precious stone from one compartment to the other.

Figure 2:
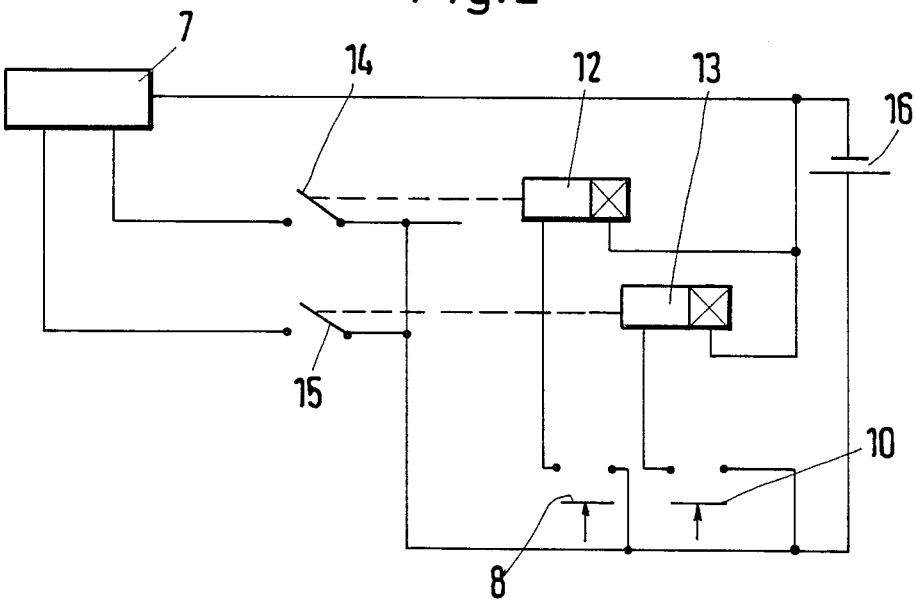
FIG. 2 is a circuit diagram of means for inverting the exhibiting apparatus shown in FIG. 1.

A simple circuit arrangement is shown in FIG. 2.

The two switches 8 and 10 control the energization of relays 12, 13 having switch contacts 14, 15, which control the energization of circuits for an operation in various senses of rotation from a battery 16.

Each of the relays 12, 13 will operate with a time delay and has a delay line for maintaining the energization after the associated contact switch 8 to 10 has been actuated. The time delay is sufficient to permit the grains of precious stone to move from the currently upper compartment into the lower one. The timing is such that the motor 7 is energized only for the required pivotal movement.

Figure 3:
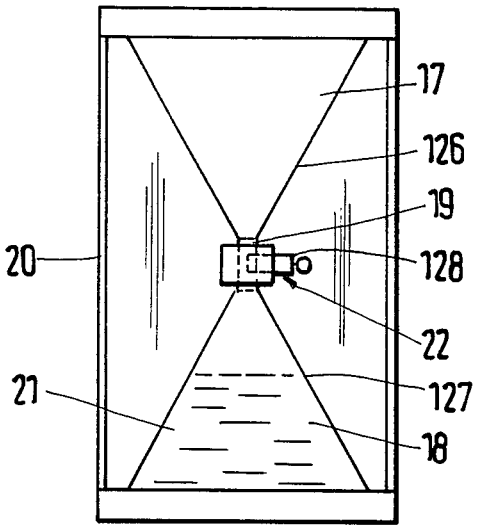
FIG. 3 is a diagrammatic side elevation showing a further embodiment of an exhibiting apparatus.

FIG. 3 shows an exhibiting apparatus which is similar to an hourglass and has two conical compartments 17, 18 which are defined by walls and communicate with each other through a constricted passageway 19. The hourglass is pivoted in a frame 20. An aggregation 21 consisting of grains of precious stone of the stated kind is contained at the bottom of the hourglass. The tapered compartments 17 are defined by inclinded wall portions 126, 127.

After the hourglass has been inverted, the grains of precious stone will be singled as they trickle into the currently lower compartment.

As an additional feature, a shutter 22 may be provided adjacent to the constricted passageway 19 and may be used to close the constricted passageway 19 and to open it to a controlled extent. In that case the singling and the timing of the grains of special stone passing through the constricted passageway can be controlled by the adjustment of the cross-section which has been opened. The shutter 22 comprises a gate, which extends through the constricted passageway 19, and an outwardly protruding handle 128.

The embodiment shown in FIG. 3 is radially symmetrical.

Figure 4:
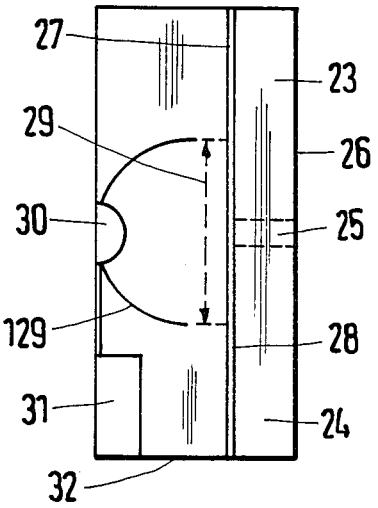
FIG. 4 is a side elevation showing an exhibiting apparatus which is flat but in other respects corresponds to that shown in FIG. 3.

In the side elevation shown in FIG. 4, the two compartments 23, 24 are shallow. They are tapered in a front elevation and communicate with each other through a constricted passage 25. In that embodiment the front wall 26 is transparent and in one embodiment the rear wall 27 is opaque and is colored or provided with a mirror coating 28 on the side which faces the compartment. The rear wall may be at least partly transparent, e.g., in a portion extending along the dotted-line arrow 29, and a light source 30 may be provided behind the transparent portion of the rear wall 27. In side elevation the side walls are also transparent so that the transparent central region at 29 is apparent. A reflector 129 provided adjacent to the region 29 has a central aperture, through which the light source 30 protrucdes into the reflector 129.

Such additional means will be provided together with batteries or terminal means, which are indicated only formally at 31.

That embodiment is also mounted in a frame 32 and may also be provided with a rotary drive such as is shown in FIG. 1.

Besides, the rigid bottom plate 5 which defines the compartments 2, 3 in FIG. 1 may be similar to the rear wall 27 shown in FIG. 4, i.e., that it may be colored or provided with a mirror coating and/or may be transparent at least in part and may have a light source associated with it.

Figure 5:
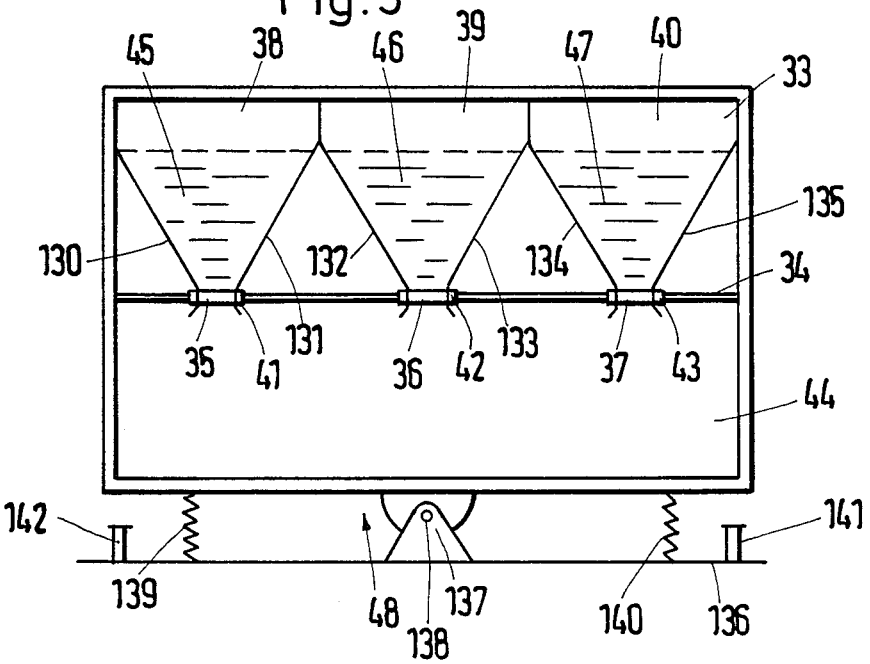
FIG. 5 is a front elevation showing a further embodiment of an exhibiting apparatus.

FIG. 5 shows an embodiment for providing pictures which simulate landscapes. A flat container 33 is provided, which has a transparent front wall. A horizonally extending partition 34 is formed with openings 35 to 37, which constitute constricted communicating passageways. Above said openings, tapering compartments 38 to 40 are provided, which are defined by side walls and serve to accommodate aggregations of grains of precious stone, particularly in different colors. The constricted passageways may contain shut-off or throttling gates 41 to 43, which may be operable individually or in unison so that different aggregations may be built up in the currently lower compartment 44 so as to provide a picture which simulates a landscape. This can be accomplished in that the aggregations 45 to 47 of grains of precious stone are permitted to flow throuygh the constricted passageways.

The compartments 38 to 40 are disposed between a transparent front wall and a rear wall and are defined by inclinded convergent side walls 130 to 135, which are at right angles to the front and rear walls. In that figure the communicating passageways 35 to 37 can be closed or can be partly opened by throttling shutters, which are only diagrammatically indicated.

The container 33 may be mounted on a seesaw 48, which may be provided with drive means as grains of precious stone will be stratified as they pass through the constructed passageways.

The frame 136 comprises pivotal mounting means 137 including a pivot 138, which is provided between the flat container 33 and the flat frame 136. The intermediate position may be defined by springs 139, 140 and stops 141, 142 may be provided for limiting the excursion. A reversible drive motor, not shown, which is of a suitable type, is coupled to the container 33.

In accordance with FIG. 5 the compartments 38 to 40 and 44 lie in a plane. In another apparatus a duplication is effected in that a partition 50 is included which is parallel to the extent of a flat container 49, tapered compartments 51, 52 defined by walls and corresponding to the compartments 38 to 40 are provided above the partition 50 and tapered compartments 53, 54 defined by walls are provided under the partition 50. The constricted communicating passageway for effecting a singling operation is designed to establish communicating passageways between a rear upper compartment 51 and a front lower compartment 54 and between the compartments 52, 53.

Figure 6:
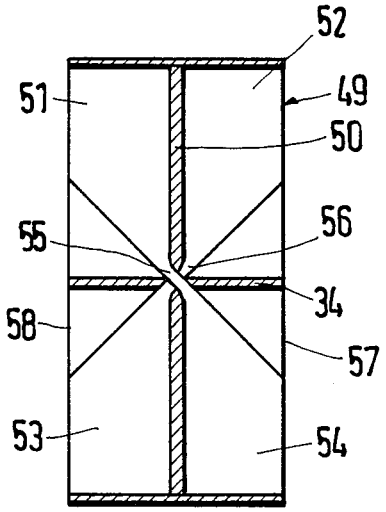
FIG. 6 is a central vertical longitudinal sectional view showing another exhibiting apparatus comprising two container assemblies as viewed through a transparent front wall of the container assembly.

In that embodiment the lower compartments 53, 54 also taper to the crossing communicating passageways 55, 56 and are defined by walls, as is apparent, e.g., from FIG. 6 showing the compartments 52, 54.

In that case, aggregations of grains of precious stone in different colors are contained in each of the sets of communicating compartments so that an inversion of the container will have the result that the grains trickling from a given upper compartment will differ in color from those trickling into the vertically aligned lower compartment. The two side walls 57, 58 may be transparent and the partition 50 may be colored or provided with a mirror coating.

Figure 7:
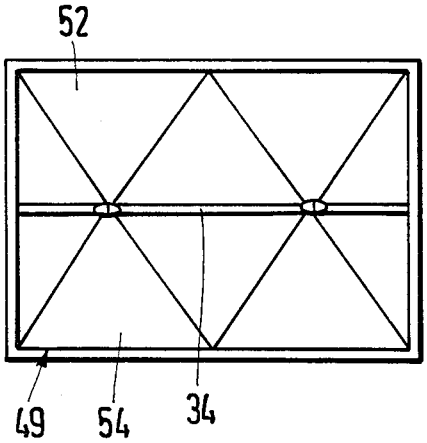
FIG. 7 is a front elevation which relates to FIG. 6.

It is also apparent from FIG. 7 that a plurality of such container assemblies may be juxtaposed.

Figure 8:
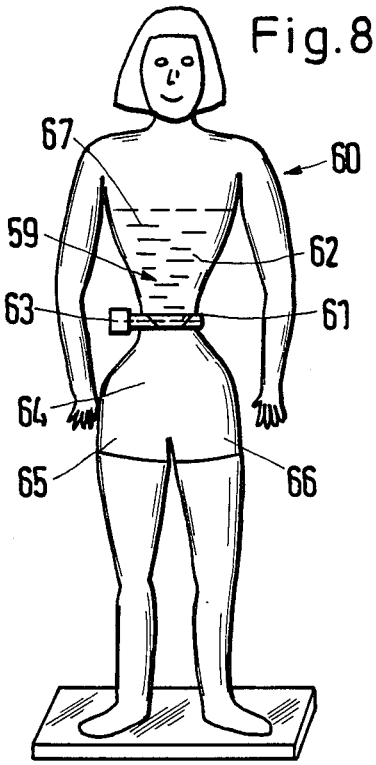
FIG. 8 shows a figure which represents the described embodiment.

FIG. 8 shows the apparatus incorporated in a female figure. A body 59 which resembles an hourglass simulates a female torso 60 and is formed with a constriction 61 at the waist. A compartment 62 for receiving an aggregation of grains of precious stone is provided above that constriction. A shut-off and throttling gate 63 is suitably provided at the constriction 61 adjacent to the waist. In that embodiment the lower compartment 64 is divided into two sub-compartments 65, 66, which receive the grains of precious stone when an aggregation 67 of grains of precious stone contained in the compartment 62 is permitted to trickle. This operation will cause the grains of precious stone to sparkle as they are exihibited, particularly when they are illuminated.

The female figure is defined by the configuration of the various compartments.

The throttling shutter 63 comprises an outwardly protruding handle and a gate, which is movable in the constricted passageway. The two lower compartments 65, 66 which constitute legs of the figure may terminate on the level of the knees or ankles.

Even where a figure is not employed, it is possible within the scope of the invention to associate two sub-compartments 65, 66 with a compartment 62.

Such an article and other articles may be used as gift articles.

Figure 9:
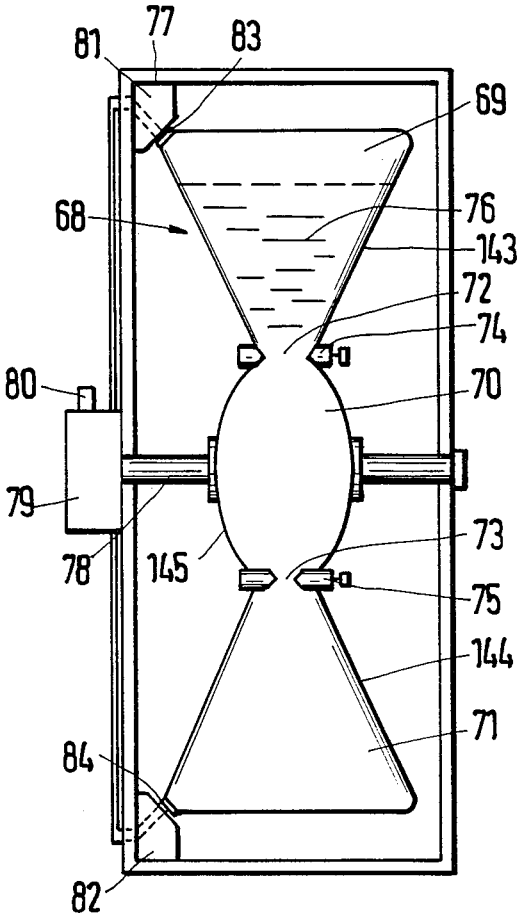
FIG. 9 shows another embodiment of a desirable apparatus.

FIG. 9 shows an exhibiting apparatus comprising a container assembly 68 in which three compartments 69 to 71 are provided, which communicate with each other through two constricted communicating passageways 72, 73. The constricted passageways may be provided with shut-off and throttling gates 74, 75 and differ in diameter. In the position shown the upper constricted passageway 72 is larger in diameter than the lower constricted passageway so that an aggregation 76 of grains of precious stone will move faster from the compartment 69 to the compartment 70 than from the latter to the compartment 71. The cross-sections may also be adjusted by the shutoff or throttling gates. The three tapered compartments 69 to 71 are defined by inclined wall portions 143, 144 and by the intermediate wall portion 145, which is elliptical in cross-section.

The container assembly 68 is mounted in a frame 77 and may be fixed to the frame so that the entire frame can be inverted when the aggregation has been transferred. But in the desirable embodiment shown by way of example, the container assembly 68 is secured to a shaft 78. The frame also carries a drive unit 79 including a motor, a power source and a switch 80. The motor is coupled to the shaft 78 and is operable to invert the container assembly 68 with the desired timing, as has been described with reference to FIG. 2. For that purpose, stop switches 81, 82 are mounted in the frame 77 and cooperate with actuating blades 83, 84 provided on the container assembly 68. The blades are sufficiently yieldable so that the drive unit when energized can move the blades in contact with the top switches. The operation of the drive unit is so timed that the drive unit will be de-energized when or before a blade has reached a stop switch. The three-dimensional arrangement is such that the container assembly will be stabilized in a slightly inclined position. This may be ensured by the provision of magnetic restraining means, the action of which can be overcome by the drive unit, as will be described with reference to FIG. 11. The shaft is secured to the wall portion 145 and is movably mounted in the frame 77 by bearings.

Figure 10:
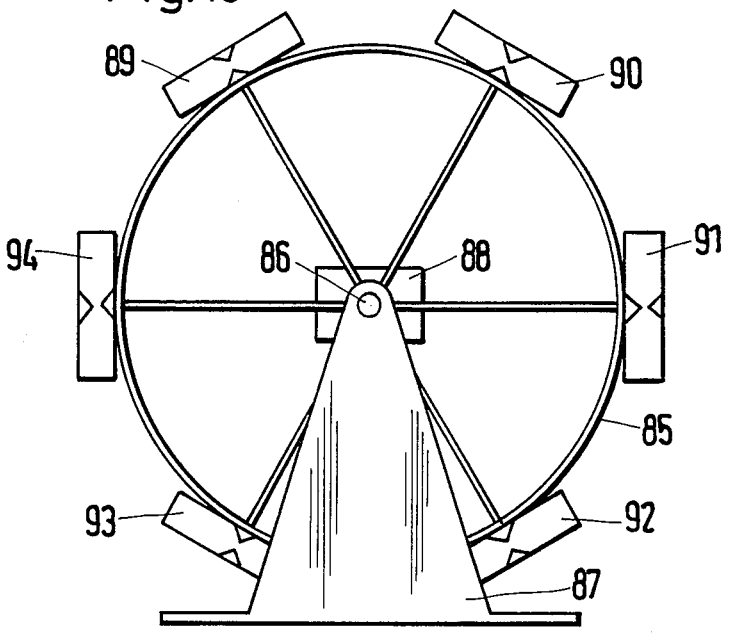
FIGS. 10 and 11 illustrate two further desirable embodiments in a diagrammatic representation and a side view.
Figure 11:
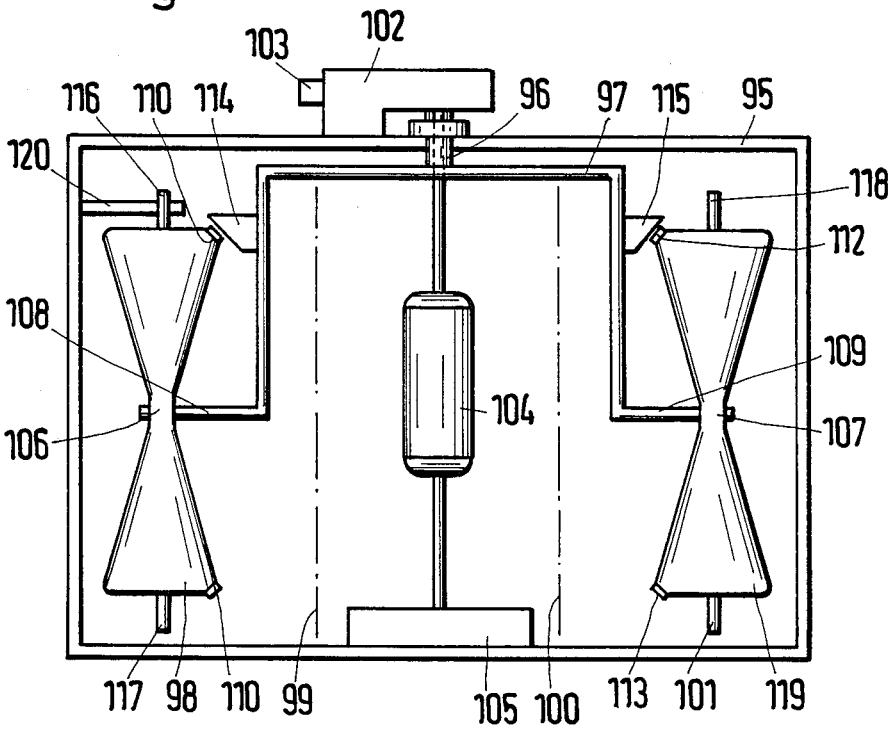

FIGS. 10 and 11 diagrammatically illustrate circular arrangements for effecting a continuous rotation in various ways. In accordance with FIG. 10 a wheel 85 is rotatable about a horizontal axis 86, which is mounted in a frame 87. A drive motor 88 is mounted in the frame 87 and serves to rotate the wheel 85 or an associated shaft that is coaxial with the axis 86. Around the periphery of the wheel, tangentially extending container assemblies 89 to 94 are provided and define two compartments each. In dependence on the quantity of the grains of precious stone in the aggregation and the flow area of the constricted passageways, the wheel is rotated at such a speed that the entire aggregation can flow from one compartment of a given container assembly into the other during one half of a revolution of the wheel 85.

FIG. 11 is a vertical longitudinal sectional view showing an embodiment which resembles a roundabout. A frame 95 is provided, in which a rotary carrier 97 is mounted on a vertical tubular shaft 96. A circular series of container assemblies 98 to 101 are suspended fro the carrier 97. The tubular shaft is adapted to be driven by a drive unit 102, which is provided with a power switch 103, by which the drive unit 102 and a light source 104 disposed at the center of the roundabout can be energized at the same time. A power supply may be provided at 105. Electric leads may extend through the supports for the light source and through its bulb sockets and may optionally extend past the light source as far as to the power switch 103 so that the light source 104 will be energized together with the drive unit 102.

Each of the container assemblies 98 and 101 may define two compartments, and adjacent to the constricted passageways 106, 107 may be rotatably mounted on the rotary carrier 97 by means of a holder 108 or 109. Each container assembly is releasably held in a given vertical position, e.g., by permanent magnet means, which comprise a magnetic element 110 to 113 that is mounted on the container assembly and another element 114, 115 that is mounted on the holder 108, 109. Each container assembly is provided at its top and bottom with stop arms 116 to 119, which in a given angular position engage a stationary stop 120, which is carried by the frame 95 and protrudes into the path of the currently upper stops 116, 118. As the carriers 97 is started, the magnetic joint is separated and the container assembly is inverted until the magnetic element 110-113 provided near the initially lower end of the container assemlby establishes a magnetic joint with the associated element 114 or 115. It is apprent that the parts 116 to 120 constitute inverting means.

The container assemblies and particularly walls which define the compartments are transparent at least in part.

I claim:

1. An apparatus for exhibiting grains of precious stone, comprising a container assembly that includes at least two compartments enclosed by container walls, a communicating passageway connecting the at least two compartments and constituting a singling path for grains of precious stone, which singling path constitutes a constriction relative to the compartments and has in relation to the size of the grains a cross-section which permits single grains to move freely through the passageway, wherein an aggregation of grains of precious stone is container in at least one of the compartments, two communicating compartments having different elevations, and the constricted passageway between said two compartments is adapted to loosen and to single the grains of aggregation thereof as they move from one compartment to another, the grains of precious stone being selected from the group consisting of monocrystalline material having planar surfaces for producing presentational light reflexes and particles having a secondary granulation and broken surfaces, and said material is selected from the group consisting of natural and synthetic diamond, zircon and sapphire, the two compartments being constricted toward the singling path and combined in the shape of an invertible hourglass.

2. Apparatus according to claim 1, which comprises a frame (9, 87), in which bearing means and at least one shaft (6, 78, 86, 108, 109) are mounted, which shaft is pivoted in the bearing means, wherein the container assembly including the at least two compartments and the at least one singling path connecting said two compartments is mounted on said shaft, a drive motor (7, 29, 88, 102) is provided, which is coupled to the container assembly and imparts to the container assembly a motion that is selected from the group consisting of an alternating adjustment of the at least two compartments associated with each other to different elevations and a circular motion of a plurality of container assemblies on the frame as in a roundabout, and the frame is provided with two stop switches, one of which is adapted to be operated when a compartment has been filled and then starts the drive motor to change the alternating elevation of the connected compartment.

3. Apparatus according to claim 1, wherein a plurality of juxtaposed exhibiting means for containing different kinds of grans of precious stone, which grains differ in size and color, are provided and a plurality of compartments for containing aggregations of grains of precious stone are juxtaposed in a flat exhibiting assembly, side walls defining the contours of the compartment are provided behind a transparent plate, which constitutes a front wall of the container assembly, and in front of a rear wall of the container assembly, and said rear wall is selected from the group consisting of transparent walls and walls provided with a mirror coating on one side.

4. Apparatus according to claim 2, wherein the frame is provided with releasable retaining means selected from the group consisting of spring clips and magnets and adapted to retain at least one container assembly which is pivotally movable through 180°, inverting means for at least one container assemlby are provided, and the inverting means comprise at least one stop, which is mounted in the frame and arranged to engage the at least one container assembly.

5. Apparatus according to claim 1, wherein a gate is provided in the singling path and is movable transversely to the singling path and is provided with an outwardly protruding handle and adapted to selectively close and open the singling path.

6. Apparatus according to claim 1, wherein the container assembly contains within the container wall at least three compartments, which are arranged one over the other, and singling paths consisting of constricted passageways are provided between any two adjacent ones of said compartments and are smaller in cross-section than said compartments.

7. Apparatus according to claim 2, wherein a circular carrier for a plurality of container assemblies is mounted in the frame.

8. Apparatus according to claim 3, wherein a container (33) comprises side walls which define tapered reservoirs (38 to 40, 52) for containing aggregations of grains of precious stone, particularly in different colors, which reservoirs are disposed above constricted passageways (35, 37), the container includes alternating movement of the container (33) to inclined positions and by a change of the elevation of the reservoirs (38 to 40, 52).

* * * * *